US005186538A

United States Patent [19]

Ito et al.

[11] Patent Number: 5,186,538

[45] Date of Patent: Feb. 16, 1993

[54] CORE AND MOLDING SAND PREPARATION APPARATUS WITH ADJUSTABLE MIXING BLADE

[75] Inventors: Junnosuke Ito, Toyonaka; Minoru Iwamoto, Osaka, both of Japan

[73] Assignee: Taiyo Chuki Co., Ltd., Osaka, Japan

[21] Appl. No.: 579,856

[22] Filed: Sep. 7, 1990

[51] Int. Cl.[5] ..... B28C 7/04; B28C 5/32

[52] U.S. Cl. ..... 366/16; 366/65; 366/177; 366/307

[58] Field of Search ..... 366/2, 8, 16, 19, 20, 366/21, 40, 64, 65, 98, 302, 307, 314, 279, 325, 67, 52, 57, 177, 306

[56] References Cited

U.S. PATENT DOCUMENTS

| | | | |
|---|---|---|---|
| 729,806 | 6/1903 | Stoveken | 366/307 |
| 1,593,093 | 7/1926 | Mitchell | 366/57 X |
| 2,513,012 | 6/1950 | Dugas | 366/65 X |
| 2,825,542 | 3/1958 | Jackson | 366/314 X |
| 2,902,681 | 9/1959 | Dietert et al. | 366/16 |
| 3,201,095 | 8/1965 | Erwien et al. | 366/314 |
| 3,387,829 | 6/1968 | Nangoh et al. | 366/64 X |
| 3,430,929 | 3/1969 | Kawecki | 366/8 |
| 3,690,622 | 9/1972 | Brunner et al. | 366/52 |
| 3,697,054 | 10/1972 | Moratschek | 366/40 X |
| 3,744,768 | 7/1973 | Kauffman et al. | 366/16 |
| 3,964,733 | 6/1976 | Tutzschky et al. | 366/314 X |
| 4,190,369 | 2/1980 | Rikker | 366/16 |
| 4,194,925 | 3/1980 | Holbrook et al. | 366/40 X |
| 4,304,493 | 12/1981 | Frankie | 366/64 X |
| 4,915,160 | 4/1990 | Reynolds | 366/132 X |
| 4,983,046 | 1/1991 | Murata et al. | 366/314 X |

FOREIGN PATENT DOCUMENTS

| | | | |
|---|---|---|---|
| 51-19806 | 6/1976 | Japan . | |
| 1517126 | 7/1978 | United Kingdom | 366/16 |

*Primary Examiner*—Harvey C. Hornsby
*Assistant Examiner*—Charles Cooley
*Attorney, Agent, or Firm*—Jansson & Shupe, Ltd.

[57] ABSTRACT

A molding sand preparation apparatus of the mixing-bowl type is suitable for preparing face sand or back sand without structural modification. The apparatus includes sand hoppers and resin and catalyst tanks as well as pumps, controls and the like for measuring proper amounts of sand, resin and catalyst and placing them into a mixing bowl equipped with rotatable agitating blades. The bowl includes flexible mixing blades, the position of which can be adjusted for changing the mixing efficiency of the apparatus.

7 Claims, 9 Drawing Sheets

CORE AND MOLDING SAND PREPARATION APPARATUS WITH ADJUSTABLE MIXING BLADE

BACKGROUND OF THE INVENTION (1) Field of the Invention

The present invention relates to a molding sand preparation apparatus and more particularly to such an apparatus which may prepare self-hardening molding sands utilizing resin and catalyst.

(2) Description of the Prior Art

Such self-hardening molding sands are prepared ordinarily by mixing some kinds of mold sands as a main ingredient, and a resin and a catalyst for curing or hardening the molding sands. For preparing the molding sands, a mixing machine of batch type having a certain capacity has been used, which machine provides agitating blades therein for mixing the mold sands of a certain quantity, the resin and the catalyst which are put into the machine. For instance, a conventional molding sand preparation apparatus having a mixing machine of batch type, is disclosed in Japanese Patent Publication No. 51-19806.

By the way, since the molding sand preparation apparatus as mentioned above utilizes the mixing machine of batch type, the quantity of the mold sands supplied to the mixing machine are divided by stages in order to control the total quantity of the molding sand and also rotation of the agitating blades of the mixing machine are controlled in order to obtain a suitable mixing condition.

However, since the mold sands comprise a facing sand for determining the face of a casting and a back sand for supporting and fixing the periphery of the facing sand, it is required to control two kinds of the mold sands.

Since the facing sand directly receives a molten metal and forms a casting face, it is preferred to be relatively hardened. Contrary to this it is preferred that the strength of hardness of the back sand is significantly lower than that of the facing sand in consideration of removing a mold box or flask economically and efficiently.

Further, since the face sand is positioned just around the casting, a small amount of the face sand is required in comparison with the back sand.

However, the conventional mold sand preparation apparatus could not easily control preparation of such a face sand and a back sand.

Moreover, the molding sand of self-hardening has to be used properly as a rapid cure molding sand and a delayed cure molding sand. Such a cure time control is carried out by controlling supply of the amount of the catalyst and therefore takes time in controlling the amount of the catalyst to be supplied.

SUMMARY OF THE INVENTION

It is an object of the present invention to provide a molding sand preparation apparatus which may prepare a face sand and a back sand so as to control a strength of a molding sand.

To achieve the above mentioned object, the molding sand preparation apparatus according to the present invention comprises a proper frame, a sand hopper provided with the proper frame for receiving a molding sand, control means for taking out a predetermined amount of the molding sand in the proper hopper, a resin tank provided with the proper frame for receiving a resin, pump control means for taking out a predetermined amount of the resin in the resin tank, a catalyst tank provided with the proper frame for receiving a catalyst, pump control means for taking out a predetermined amount of the catalyst in the catalyst tank which amlunt corresponds to the amount of the resin at a predetermined ratio, a powder hopper provided with the proper frame for receiving a powder, screw feeder control means for taking out the powder in the powder hopper when a face sand is prepared, rotatable mixing means provided with the proper frame for receiving the sand, the resin, the catalyst and/or the powder and mixing these together therein, and control means for controlling rotation of the rotatable mixing means, thereby a face sand or a back sand is prepared.

Namely, according to the present invention, when for instance a face sand is mixed and prepared, a fresh sand, a silica sand or a zircon sand and the like is taken out from the sand hopper in an amount relatively small compared to the amount used in preparation of a back sand and then thrown into rotatable mixing means. Further, a relatively large amount of the resin is taken out from the resin tank and also the catalyst is taken out from the catalyst tank with the amount corresponding to the amount of the resin at a predetermined ratio and these are thrown into the rotatable mixing means. Further, a predetermined amount of the powder such as ferrous oxide powder is taken out from the powder hopper and thrown into the rotatable mixing means. Thus, the rotatable mixing means is rotated at a predetermined number of revolutions to carry out agitation for a predetermined time.

When a back sand is prepared, an amount of sand (which is relatively large compared to the amount used to prepare a face sand) is taken out of the hopper and thrown into the rotatable mixing means. A small amount of the resin is taken out from the resin tank and the catalyst is taken out from the catalyst tank with the amount corresponding to the amount of the resin and both are thrown into rotatable mixing means so as to mix the sand, resin and catalyst together. At the time, the powder for the face sand is not thrown or mixed.

Thus, the present invention has an advantage that the face sand and the back sand necessary for a molding sand are prepared separately and those materials are mixed at a desired and suitable ratio.

Another object of the present invention is to control a cure or hardening time for the face sand and/or the back sand.

To achieve the second object, the present invention provides control means for controlling pump control means for taking out the catalyst in the catalyst tank in order to take out an amount of catalyst greater than the amount of the resin.

Other objects and advantages will be apparent from the following description on the basis of the drawings.

BRIEF DESCRIPTION OF THE DRAWINGS

The drawings show an embodiment of a molding sand preparation apparatus according to the present invention in which.

Figure 1:
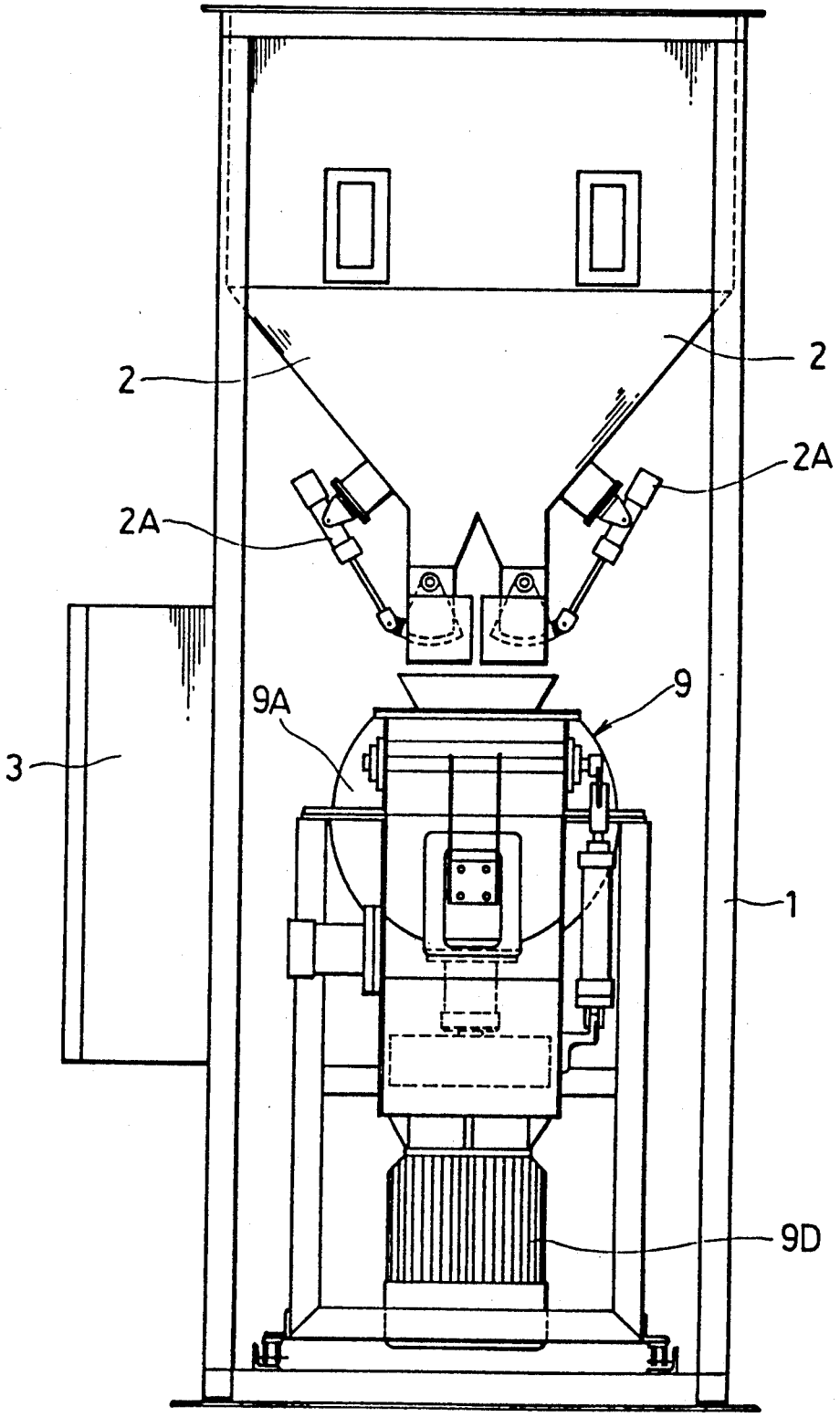
FIG. 1 is a front elevational view of the apparatus.
Figure 2:
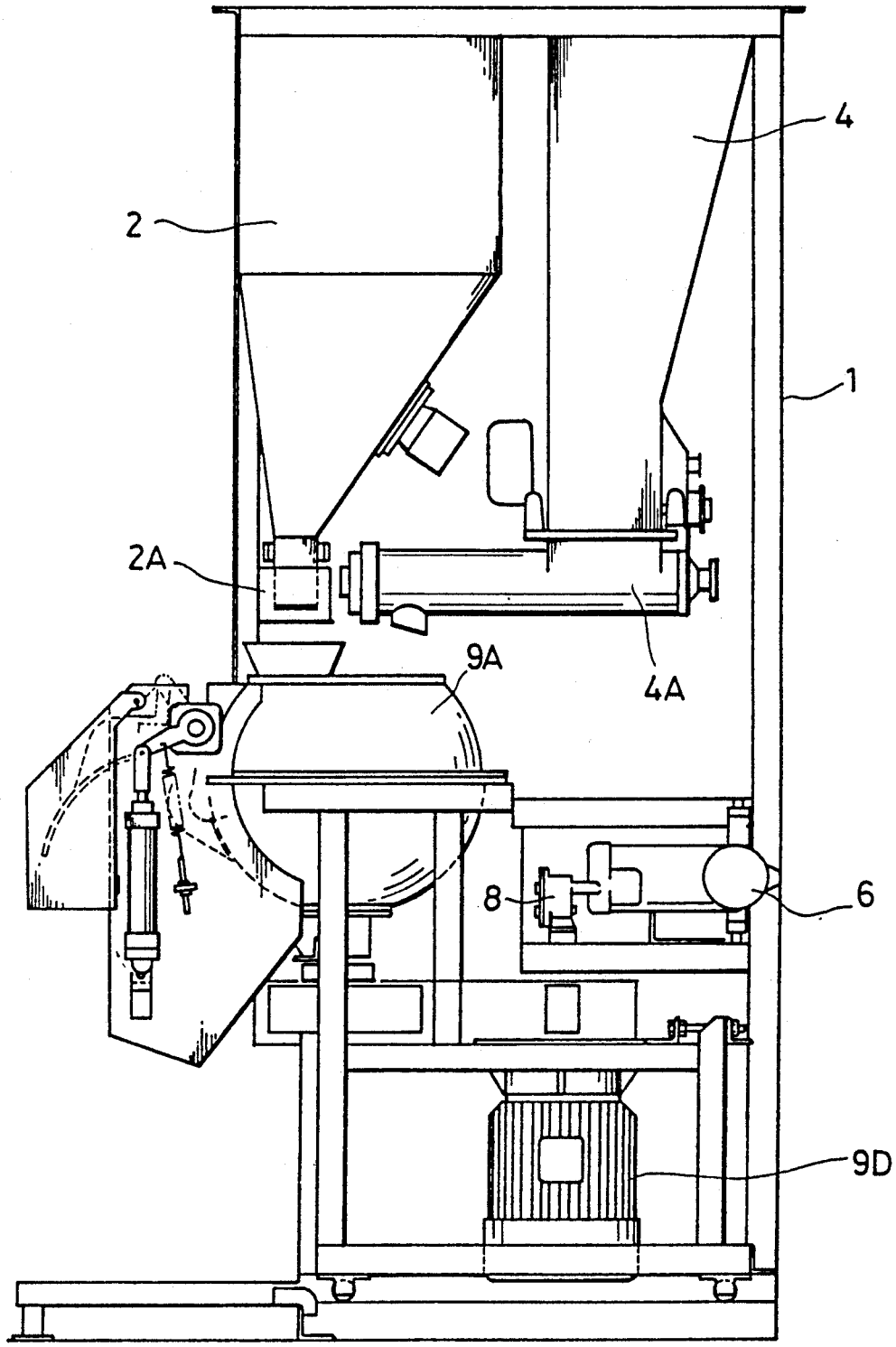
FIG. 2 is a side elevational view of the apparatus.
Figure 3:
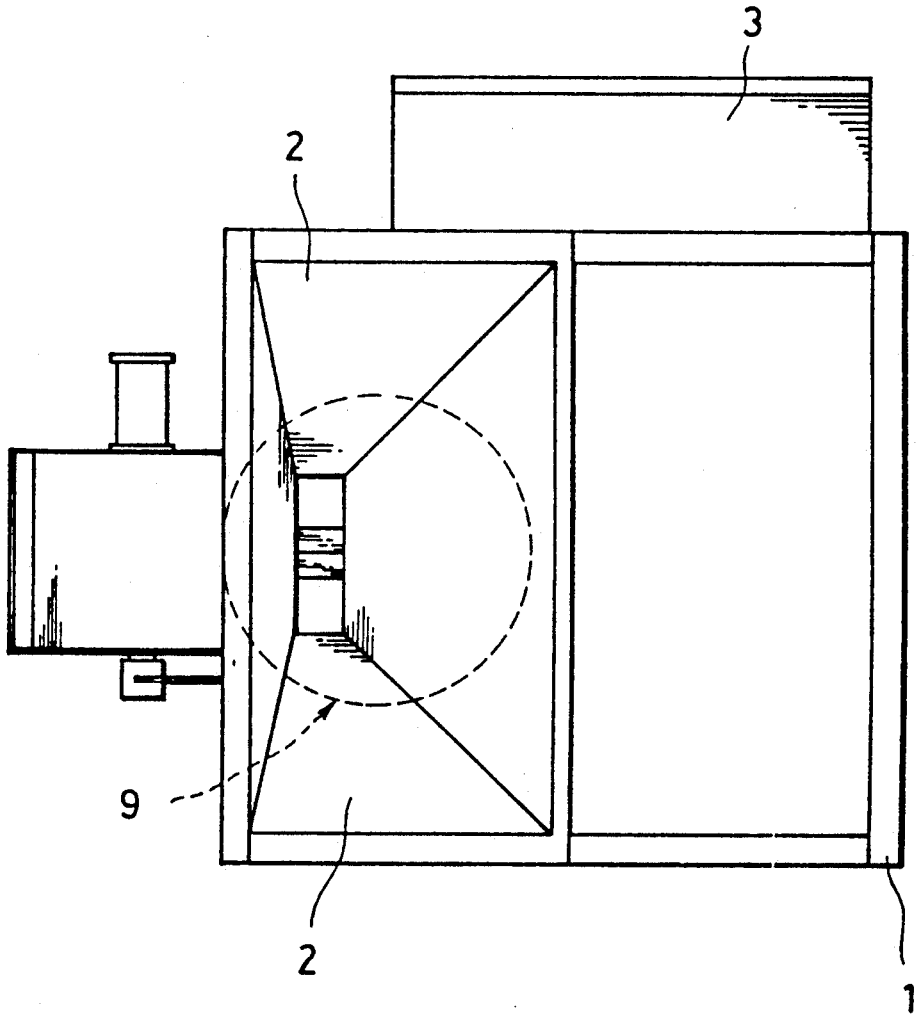
FIG. 3 is a top plan view of the apparatus.

DETAILED DESCRIPTION OF THE PREFERRED EMBODIMENT 1 designates a proper frame of a molding sand preparation apparatus and a sand hopper 2 for receiving a mold sand is mounted on the upper portion thereof.

The mold sand used in this embodiment for preparing a face sand and a back sand, are fresh sands and reclaimed sands and their materials may comprise a silica sand, a chromite sand, a zircon sand or a mixture thereof.

To prepare these sands effectively, the sand hopper 2 in this embodiment is constructed to be two compartments isolated from one another in accordance with a mixing process (Furan, Pep set $Co_2$ and etc.).

The dual compartment sand hopper 2 provides a control device 2A at the lower portion of each of the two compartments respectively which device has a shutter mechanism actuated by means of a hydraulic cylinder. The control device 2A is controlled by a control board 3 so as to take out a predetermined amount of sand (the amount corresponding to a face sand, a back sand or the size of a mold).

4 indicates a powder hopper for receiving a powder of ferrous oxide which is used in preparation of a face sand, and it is positioned adjacent the sand hopper 2. A screw feeder control device 4A is provided with the lower portion of the powder hopper 4 in order to take out a predetermined amount of the powder. An electric motor of the screw feeder control device 4A is controlled by the control board 3 to take out the predetermined amount of the powder. The screw feeder of the screw feeder control device 4A has the same construction which is used conventionally in the art of this field and therefore its detailed description is omitted here.

5 shows a resin tank used for receving a resin which is used as a binder for the sand.

6 indicates a pump control device for taking out a predetermined amount of the resin in the resin tank 5.

7 shows a catalyst tank which receives a catalyst having catalytic action in response to the resin. The catalyst tank 7 provides an opening which is positioned outwardly of the proper frame 1 so as to be able to easily supply or pour the catalyst into the opening from the outside thereof.

8 indicates a pump control device which is so constructed as to take out the catalyst of the catalyst tank 7 with a predetermined amount and comprises an ordinary gear pump and an electric motor for driving the pump. The electric motor is controlled by the control board 3 so as to take out the amount of the catalyst which corresponds to the amount of the resin at a predetermined ratio.

Figure 4:
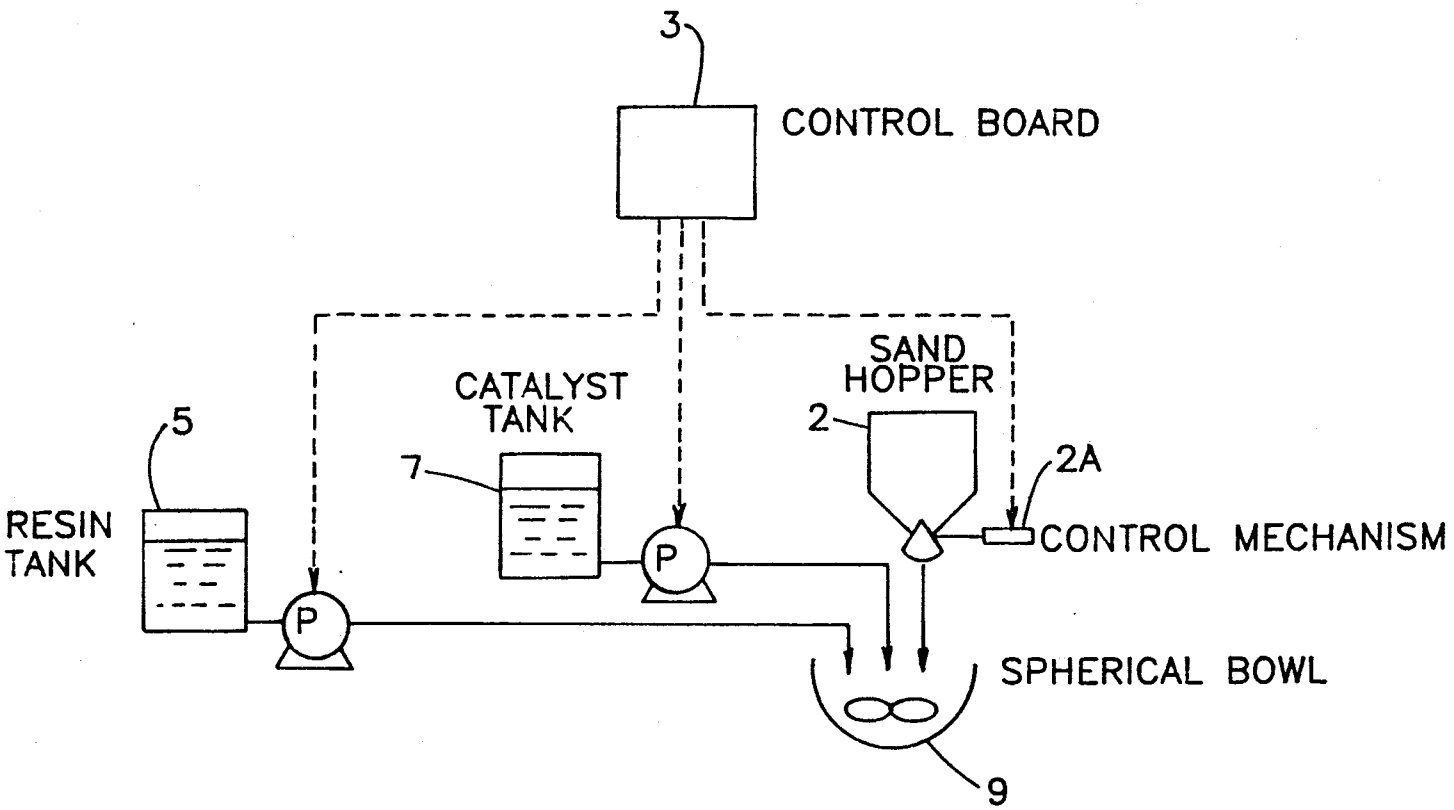
FIG. 4 is a block diagram of the apparatus and its control system.

FIG. 4 shows a control system which comprises the control device 2A for the sand, the pump control device 6 for the resin, the further pump control device 8 for the catalyst and the control board 3 for controlling these devices.

Figure 5:
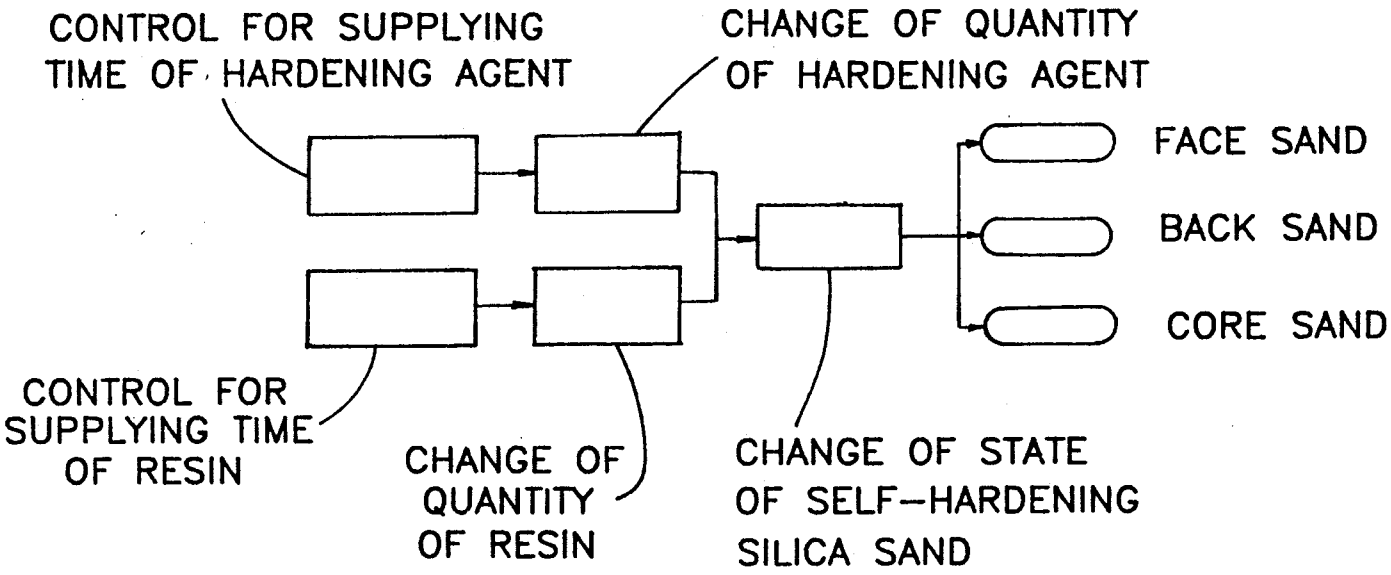
FIG. 5 is a block diagram of control system for controlling the strength of a sand.

FIG. 5 shows a block diagram of a control system for controlling a strength of the molding sand suitable for the face sand or the back sand.

Figure 6:
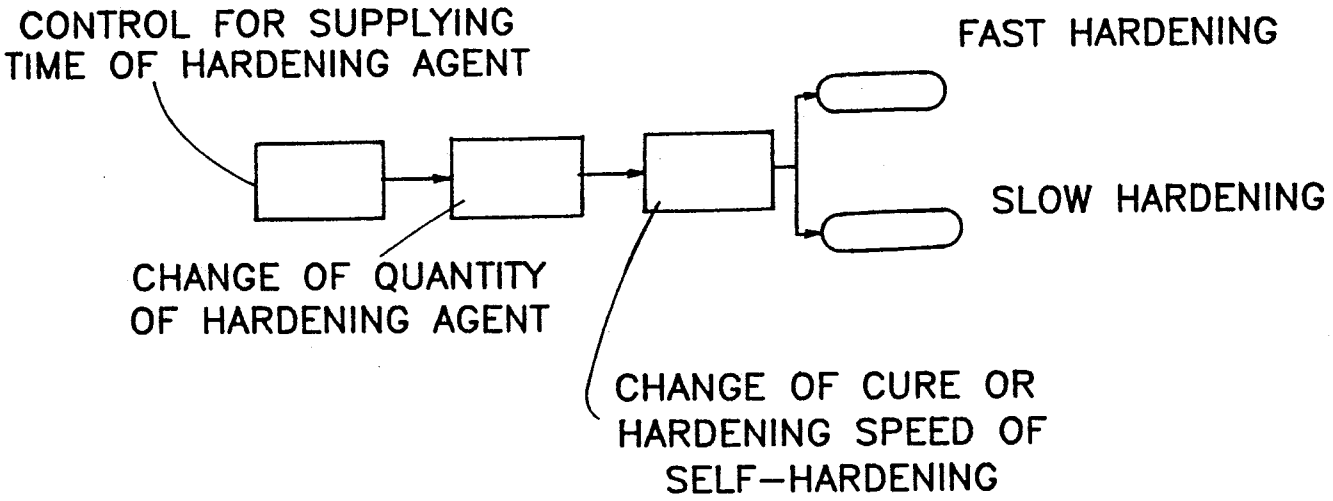
FIG. 6 is a block diagram of control system for controlling a cure or hardening speed of the sand.

FIG. 6 shows a block diagram of a control system for controlling a cure or hardening speed (time) of the face sand and/or the back sand.

Figure 7:
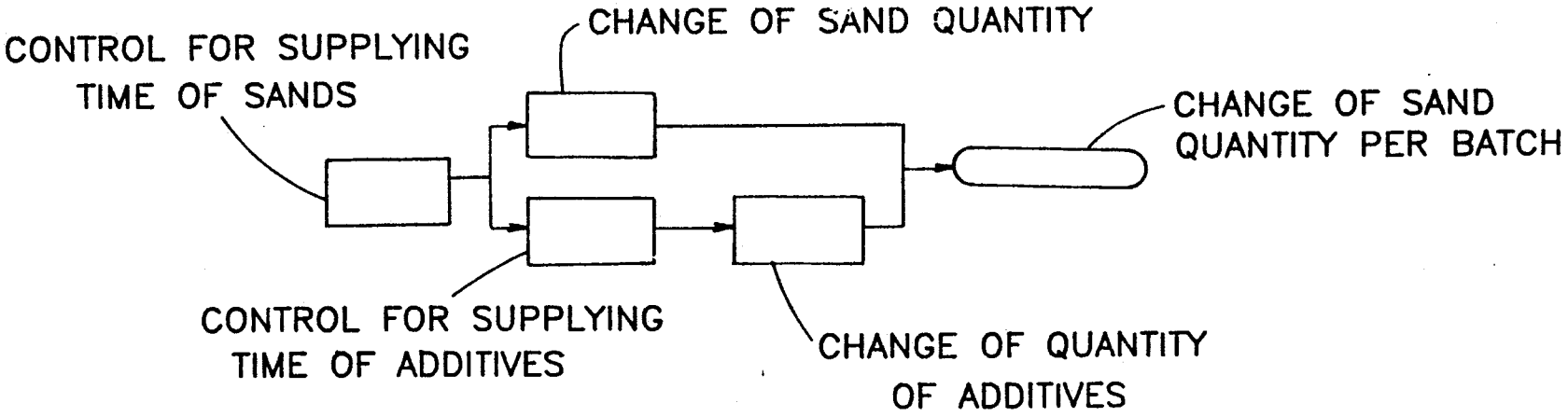
FIG. 7 is a block diagram of control system for controlling the quantity of the sand.
Figure 8:
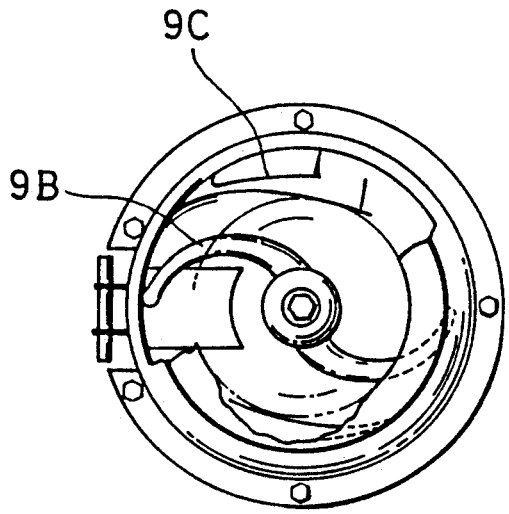
FIG. 8 is a top plan sectional view of an essential portion of rotatable mixing means.

FIG. 7 shows a block diagram of a control system for controlling an amount or quantity of the face sand or the back sand to be prepared.

In the control system for the amount of the sand according to FIG. 7, an amount of each of the resin, the catalyst and, if a face sand is being prepared, the powder corresponding to the amount of the sand at a predetermined ratio, may be controlled and further an amount of the catalyst for controlling a cure speed and also an amount of each of the resin and the catalyst (and the powder, if required) may be controlled by means of timers corresponding thereto and easily adjusted with manual operation of the timers.

9 shows a rotatable mixing device. As shown in FIGS. 2, 8, 9 and 10, the rotatable mixing device 9 may receive the sand, the resin, the catalyst and/or the powder and comprises a spherical bowl 9A as a vessel for mixing these materials, agitating blades 9B rotatable in the spherical bowl 9A, stationary blades 9C fixed in the spherical bowl 9A, and an electric motor 9D for driving the agitating blades 9B.

The spherical bowl 9A has a capacity which may carry out four stages with the weight of the sand, i.e. 8 Kg, 10 Kg, 24 Kg or 32 Kg in the treatment of a batch.

The electric motor 9D is so constructed that the rotation of the motor may be controlled by the control board 3, which is constructed as control means.

The rotatable mixing device 9 is arranged to be movable in lateral directions on the rails laid under the proper frame 1, so as to be able to easily carry out maintenance of the bowl 9A, the agitating blades 9B or the stationary blades 9C.

The agitating blades 9B comprise a pair of blades which form a semicircle in a side view along the bottom of the bowl 9A, and are driven to rotate clockwise.

Figure 9:
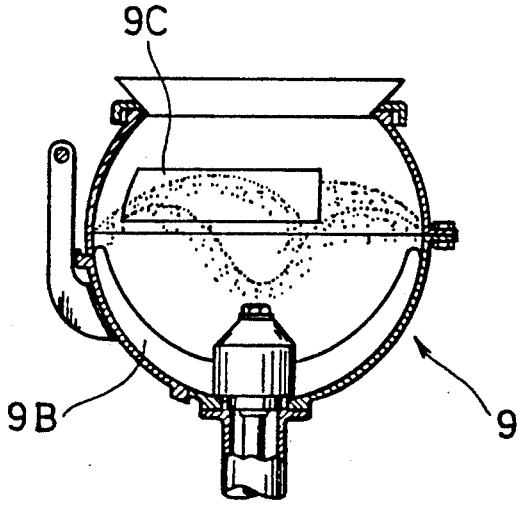
FIG. 9 is a cross sectional side elevational view of rotatable mixing means partially broken away.
Figure 10:
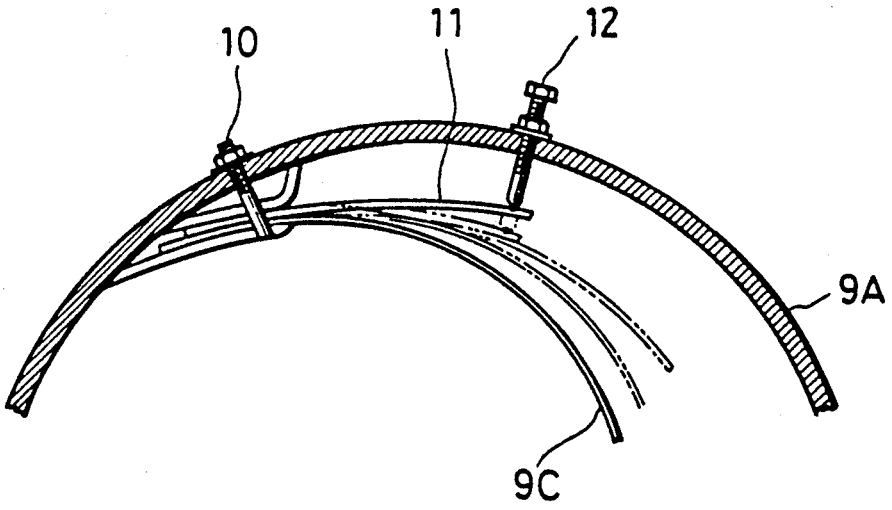
FIG. 10 is an enlarged cross sectional view of the essential portion of the rotatable mixing means.

The stationary blades 9C comprise a pair of blades which are arranged in the inner wall adjacent an upper opening of the bowl 9A. One end of each blade 9C is secured to the bowl 9A by a bolt 10. As shown in FIGS. 9 and 10, the stationary blades 9C are generally rectangular in shape and are so arranged that their longitudinal directions are directed to the periphery of the bowl 9A. Further, each of the ends of the stationary blades 9C is bolted at the longitudinal directions thereof and in the downstream of rotation of the agitating blades 9B, and their free ends are made to project inwardly of the bowl 9A.

11 indicates a short adjusting plate used with each of a pair of the stationary blades 9C, and the position of its free end is adjusted by a bolt 12, so that the projecting amount of the stationary blades 9C towards the inside of the bowl 9A can be adjusted.

Further, the stationary blades 9C are so constructed that the free ends of the blades may be shifted flexibly in a radial direction of the bowl 9A. Therefore, with the multiple effects in combination of the spherical bowl 9A, the agitating blades 9B rotatable in the bowl 9A and forming a semicircle in a side view and the stationary blades 9C fixed in the bowl 9A, a mixing time may be shortened to a few seconds so as to increase mixing efficiency per hour in spite of small size.

What is claimed is:

1. A dual purpose batch type sand preparation apparatus comprising:

a frame;

a sand hopper supported by the frame for containing a molding sand;

control means for dispensing a predetermined amount of fresh molding sand from the hopper;

a resin pump and a resin tank supported by the frame for containing a resin;

resin pump control means for dispensing a predetermined amount of the resin from the tank;

a catalyst tank for containing a catalyst;

a catalyst pump and catalyst pump control means for dispensing a predetermined amount of the catalyst in a predetermined ratio to the amount of the resin;

a powder hopper supported by the frame for containing a powder;

a screw feeder and screw feeder control means for dispensing the powder when a face sand is prepared;

mixing means supported by the frame for receiving the sand, the catalyst and a face sand powder;

such mixing means including a stationary mixing bowl having at least one flexible mixing blade attached thereto;

rotatable agitating blades in the mixing bowl for mixing the sand, catalyst, and powder;

such mixing blade having a fixed end attached to the bowl and a movable end extending into the bowl and positionally adjustable for modifying mixing efficiency of the apparatus;

position adjustment of the movable end being by a bolt extending between the mixing blade and the bowl.

2. The apparatus of claim 1 wherein the movable end is positionable radially inward and radially outward with respect to the bowl.

3. The apparatus of claim 2 wherein the bolt extends through the exterior wall of the bowl and is adjustable at said exterior wall.

4. The apparatus of claim 3 wherein the mixing blade is rectangular and such mixing blade extends longitudinally generally along the interior wall of the bowl.

5. The apparatus of claim 1 including a pair of flexible mixing blades attached to the mixing bowl, the bowl is generally spherical and the mixing blades are spaced about 180° apart.

6. The apparatus of claim 5 wherein adjustment of each blade is by a separate bolt.

7. The apparatus of claim 6 wherein each mixing blade is rectangular and extends longitudinally generally along the interior wall of the bowl.

* * * * *